United States Patent [19]

Rogers, Jr. et al.

[11] 4,357,049

[45] Nov. 2, 1982

[54] ONE-WAY RECLINER CHAIR

[76] Inventors: Walter C. Rogers, Jr., P.O. Box 685, Denton, N.C. 27239; David S. Hoffman, 1518 York Ave., High Point, N.C. 27260

[21] Appl. No.: 177,478

[22] Filed: Aug. 12, 1980

[51] Int. Cl.[3] ..... A47C 1/02

[52] U.S. Cl. ..... 297/75; 297/85

[58] Field of Search ..... 297/85, 84, 89, 75, 297/88

[56] References Cited

U.S. PATENT DOCUMENTS

| | | | |
|---|---|---|---|
| 3,400,975 | 9/1968 | Rogers, Jr. | 297/75 |
| 3,537,747 | 11/1970 | Rogers, Jr. | 297/85 |
| 3,790,211 | 2/1974 | Caldwell | 297/75 |
| 3,904,240 | 9/1975 | Rogers et al. | 297/85 |
| 3,958,827 | 5/1976 | Re | 297/322 |
| 4,071,276 | 1/1978 | Cecil | 297/85 |

*Primary Examiner*—Francis K. Zugel

*Attorney, Agent, or Firm*—William E. Mouzavires

[57] ABSTRACT

A recliner chair having a seat and backrest rigidly interconnected to move as a unit and being mounted on a stationary frame for movement into reclining positions by the chair occupant pulling-off the armrests which are included as part of the stationary frame. The footrest mechanism is actuated to extended position when the seat and backrest unit is moved into reclining position by means of the linkage mechanisms which mount the seat and backrest unit to the main frame; the latter being effected through a drive transmission linkage interconnecting the footrest mechanism with the mounting mechanism of the seat and backrest unit. The footrest mechanism provides dual footrest or leg supports which are positioned generally in vertical planes one behind the other at the front of the chair when in the retracted position. Due to an improved footrest mechanism, the footrest supports are positioned sufficiently below the front edge of the seat to permit the front edge of the seat frame to be provided with a soft construction for comfort.

8 Claims, 7 Drawing Figures

ONE-WAY RECLINER CHAIR

BACKGROUND OF INVENTION

The present invention relates to "one-way" reclining chain which is a chair whose seat and backrest are rigidly interconnected to operate as a unit at all times. Moreover, the footrest mechanism is actuated to extended position simultaneously with movement of the seat and backrest unit into reclining position. The seat and backrest unit are mounted to a rigid, stationary frame which in one form of the chair includes the armrests. In order to move the seat and backrest unit into the reclining position with the footrest extended, the chair occupant pulls off the armrests to move the seat and backrest unit forwardly relative to the stationary frame which also actuates the footrest mechanism to extended position.

With such chairs of the prior art, it is common for the footrest support when in the closed position, to lie at the front of the chair in front of the forward edge of the seat frame and directly below the forward edge of the seat cushion. As a consequence, the upper edge portion of the footrest support which includes a rigid frame piece, can be felt by the occupant through the seat cushion as a hard edge causing discomfort at times.

OBJECTS OF THE PRESENT INVENTION

One of the objects of the present invention is to provide an improved one-way reclining chair employing a flexible front edge portion in the frame of the seat which will avoid discomfort to the user of the chair. Included herein is the provision of such a chair wherein the footrest support is positioned below the front edge of the seat frame to enable the latter to be formed with a flexible or soft construction and yet without increasing the overall chair depth to keep within desired styling requirements.

A further object of the present invention is to provide a novel footrest linkage mechanism including dual footrest supports which may be easily incorporated into a one-way recliner chair.

Another object of the present invention is to provide such a one-way recliner chair which will achieve the above objects by the provision of a footrest mechanism including dual footrests or leg supports which are incorporated into the chair through means of the novel footrest linkage mechanism.

SUMMARY OF INVENTION

In summary, the present invention is achieved in a one-way reclining chair having a seat frame whose forward edge portion is formed with a flexible construction which underlies the front portion of the seat cushion so as not to be felt as a hard edge by the chair occupant and thereby avoid any discomfort. The footrest mechanism is provided with dual footrest or leg supports which, when in the closed position, lie in generally vertical planes, one behind the other, and below the flexible front edge portion of the seat frame. A novel and improved footrest linkage mechanism is provided mounting the aforesaid footrest supports relative to the seat frame in the closed position described above and in an extended position projected forwardly and upwardly from the front of the seat with the footrest supports lying one behind the other.

DRAWINGS

Other objects and advantages of the present invention will become apparent from the following more detailed description taken in conjunction with the attached drawings in which.

DETAILED DESCRIPTION

Basic Chair Parts

Figure 1:
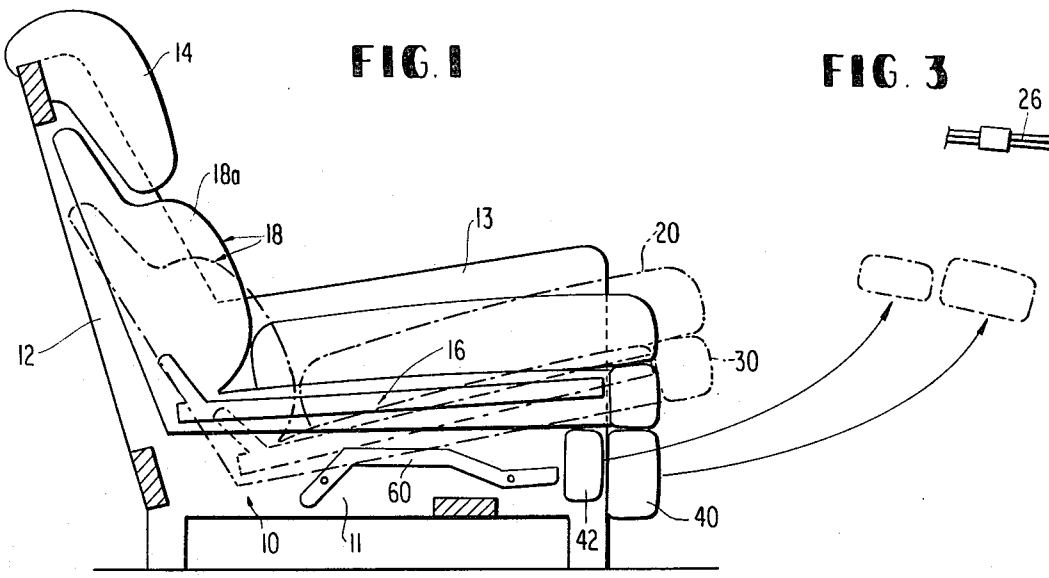
FIG. 1 is a side elevational view of a one-way recliner chair constituting a preferred embodiment of the invention and shown in schematic fashion including phantom lines to indicate a reclining position of the chair.

Referring now to the drawings in detail and initially to FIG. 1, there is shown for illustrative purposes only, a one-way reclining chair embodying the present invention. The basic parts of the chair include a stationary frame 10 including a horizontal base 11, a generally vertical back 12, and armrests 13 rigidly fixed relative to each other as a one-piece structure. Any suitable chair construction may be utilized in forming the stationary frame 10. Supported on the base 11 is a seat generally designated 16 and a backrest generally designated 18, these parts being rigidly united as a single unit to be movable relative to the base 11 by a linkage mechanism to be described. Seat 16 includes a seat cushion 20, and backrest 18 includes a cushion **18*a*. In the preferred embodiment shown, a headrest cushion 14 is utilized fixed to the stationary back 12 at the top thereof; it being understood that the backrest cushion 18*a* is carried by the movable seat and back frame unit. The movable seat and backrest unit may have any suitable frames underlying cushions 18 and 20; the frames being rigidly interconnected by link 16*b***.

Figure 3:
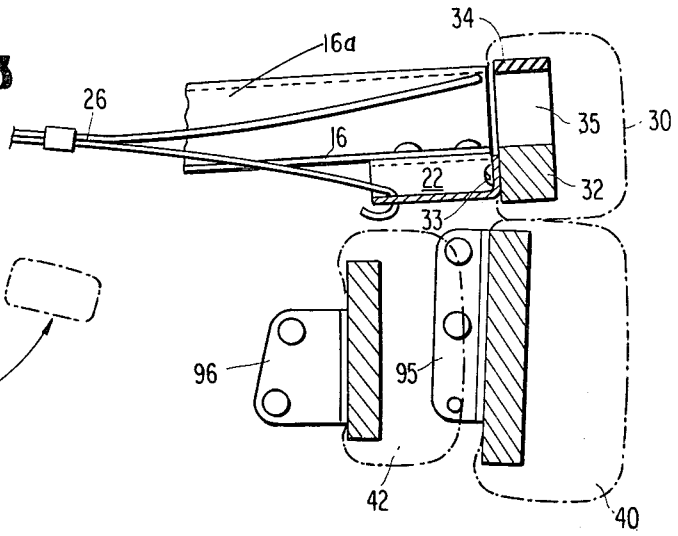
FIG. 3 is an enlarged cross-sectional side view of the front portions of the seat and footrest support frames when in the closed position of the chair.

The basic chair parts further include a footrest mechanism which includes dual footrest or leg supports 40 and 42 which are also shown in FIG. 3 in the closed position of the chair, that is, in the generally upright position of the chair. A linkage system on each side of the chair mounts the seat and backrest unit 16, 18 relative to the stationary chair frame 10 for movement between the position shown in full lines in FIG. 1 and the reclining position shown by the phantom lines in FIG. 1. The linkage mechanism further includes a footrest linkage which is actuated simultaneously with movement of the seat and backrest into the reclining position. Return of the seat and backrest into the closed position also causes retraction of the footrest mechanism to the closed position shown by the solid lines in FIG. 1.

Figure 2:
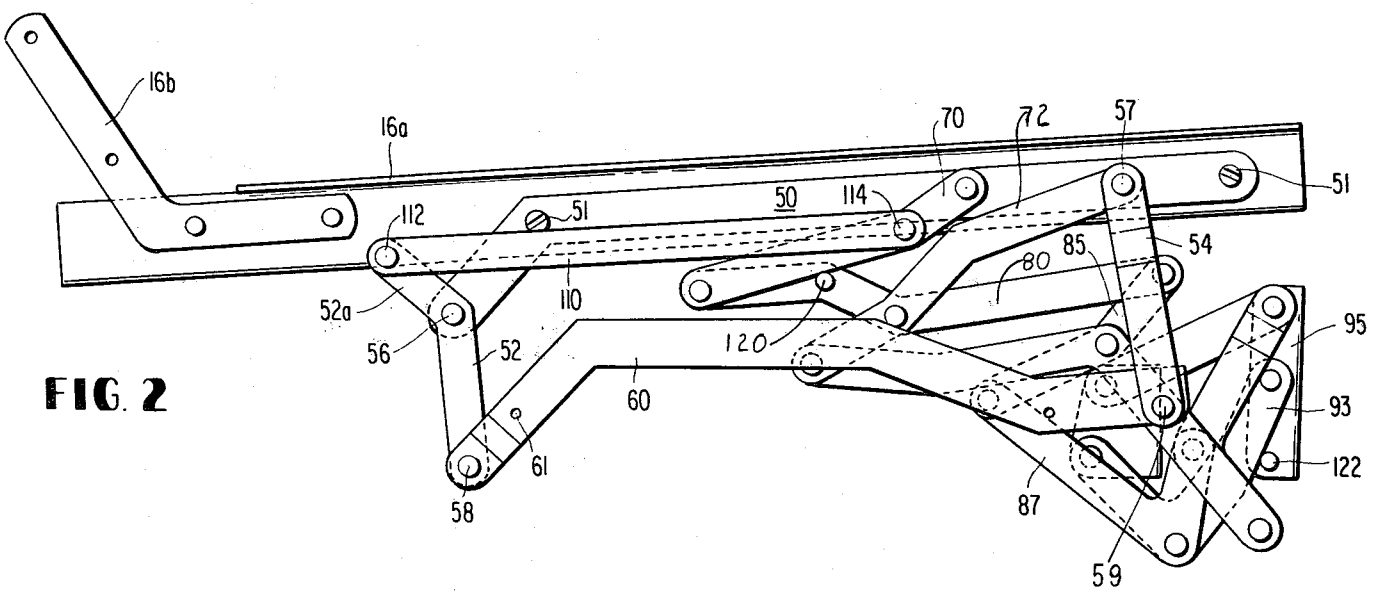
FIG. 2 is an enlarged side elevational view of a linkage system incorporated in the chair and shown in the position when the chair is in the closed or normal generally upright position.
Figure 5:
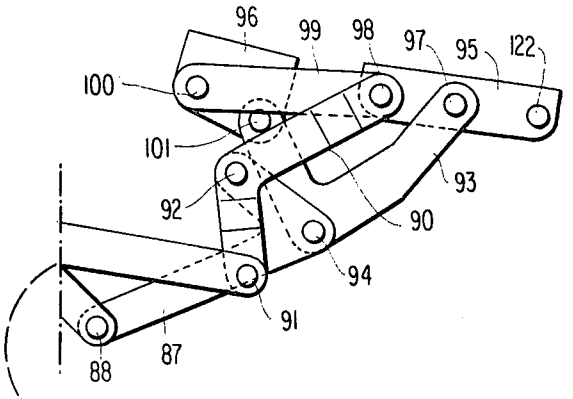
FIG. 5 is a front elevational view of the front edge portion of the seat frame with the upholstery being shown in phantom lines.
Figure 5:
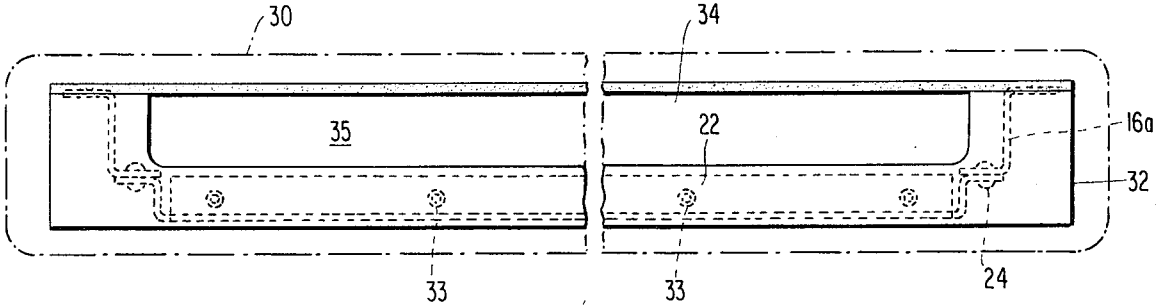

Referring now to FIGS. 2 and 5, the front edge portion of the frame of the seat 16 includes a horizontal rail 22 having opposite end flanges which are fixed, such as by the rivets 24 to opposite side rails 16*a* of the seat frame as best shown in FIG. 5. In front of the rail 22, there is attached to it a front rail including a frame portion 32 which is fixed by screws 33 to the rail 22. Front rail 32 which may be formed from wood or any other suitable material, has a shallow generally U-shaped slot 35 extending substantially throughout its length as shown in FIG. 5 and positioned over slot 35 is an elastic band 34 suitably attached at its opposite ends to rail 32. The entire structure is enclosed by any suitable upholstery 30. When the chair is occupied, elastic band 34 will be free to flex downwardly to avoid any hard edge imposed on the legs of the chair occupant. For completeness, it is also noted that rail 22 provides an anchoring point for a conventional "fish mouth" spring 26 (see FIG. 3) incorporated into the frame of the seat in conventional fashion. While rail 22 is preferably formed from a metallic channel, any other construction of suitable strength may also be employed.

The Linkage System

The entire linkage system for the chair parts described above includes two linkage mechanisms one on each side of the chair. These linkage mechanisms are mirror images of each other, therefore only one mechanism need be described here.

Figure 4:
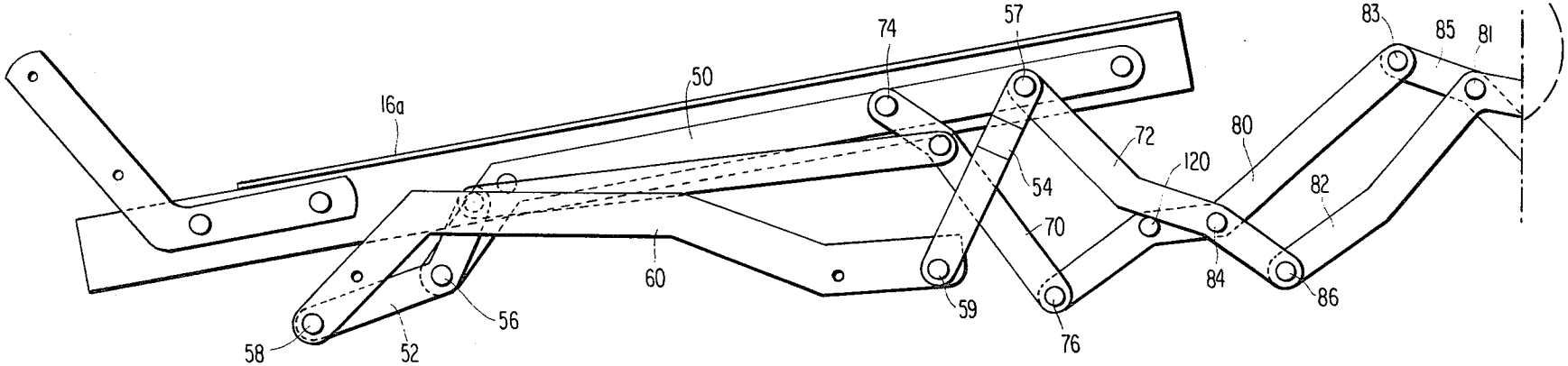
FIG. 4 is a view similar to FIG. 3 but showing the parts when the chair is in the reclining position with the footrest extended.
Figure 6A:
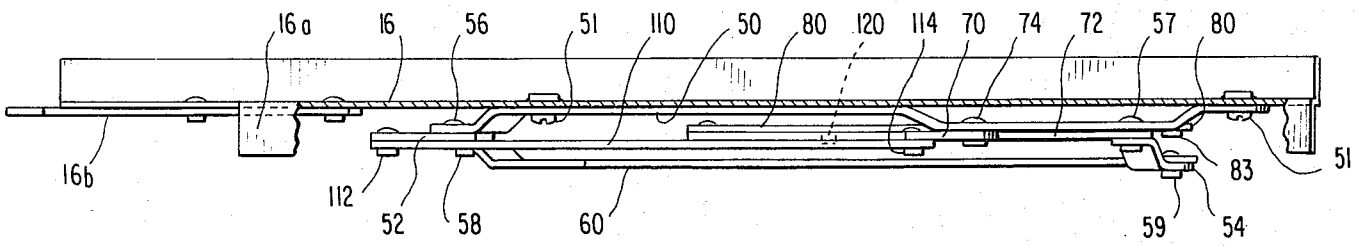
FIG. 6A is a top plan view of FIG. 4 with certain parts deleted for purposes of clarity.
Figure 6B:
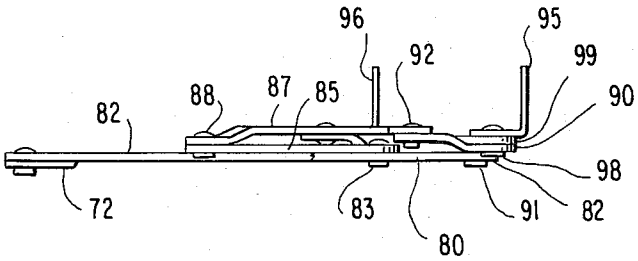
FIG. 6B is a fragmentary plan view of FIG. 4 showing the parts deleted from FIG. 6A.

Referring now to FIGS. 2 and 4, the linkage mechanism on the right-hand side of the chair which mounts the seat and backrest unit 16, 18 relative to the stationary frame 10 includes, in the preferred embodiment, an elongated seat link 50 fixed, such as by screws 51 along the side rail 16*a* of the seat frame to move with the latter at all times. A stationary frame link 60 is fixed through apertures 61 to the inner side of the base 11 of the stationary frame 10; and front and rear seat mounting links 54 and 52, respectively, are pivotally mounted to and between seat link 50 and stationary frame link 60. Rear mounting link 52 is pivoted by pin 56 to the rear end portion of seat link 50 which rear end portion projects downwardly from the main portion of link 50. Pivot pin 58 pivotally mounts the other end of rear seat mounting link 52 to stationary frame link 60. Front seat mounting link 54 is mounted to seat link 50 by means of pivot pin 57 and to link 60 by means of pivot pin 59. It will be seen that the links 50, 60, 52 and 54 form a four-bar linkage which will allow the seat frame 16 to move relative to the stationary frame 10 when the occupant is sitting in the chair and pulls-off the armrests 13 so as to move the seat 16 forwardly relative to the stationary frame 10. During the latter motion, the seat and backrest unit 16, 18 will move into reclined positions governed by the four-bar linkage mentiond above, the full reclined position being shown in phantom lines in FIG. 1.

The Footrest Linkage

Referring to FIG. 4, the footrest mechanism includes footrests mounting links 70 and 72 suspended one behind the other by pivot pins 74 and 57, respectively, from the front portion of seat link 50. Footrest mounting links 70 and 72 operate generally parallel to each other. A second pair of generally parallel links, namely 80 and 82, are pivotally connected to the footrest mounting links 70 and 72. Link 80 is connected by pivot pin 76 to link 70 while link 82 is connected by pivot pin 86 to link 72. Furthermore, link 80 is pivotally connected by pivot pin 84 to an intermediate portion of link 72. It will be seen that the two pairs of links 70, 72 and 80, 82 will act as a "pantograph" or "lazy tong" linkage.

Continuing now with the footrest mechanism, a link 85 is provided pivotally interconnecting links 80 and 82 by means of pivot pins 83 and 81, the latter being located at an intermediate portion of link 85. When the footrest is extended by linkage to be described, link 85 will act as a bell crank to unfold the footrest supports 30 and 40 into their extended position shown in FIG. 4. This is achieved through a generally L-shaped link 87 pivotally connected by pin 88 to the end of link 85. The forward end of link 87 as shown in FIG. 4 carries a footrest mounting bracket link 93 which is pivoted to link 87 by the pivot pin 94. Link 93 has a generally V-shaped configuration, one leg of which is pivoted by pin 97 to a footrest mounting bracket 95 and the other leg of which is pivoted by pin 101 to the other footrest mounting bracket 96. Bracket 95 is fixed to and supports the frame of the footrest support 40, while bracket 96 is fixed to and supports the frame of the footrest support 42 (see FIG. 3). Footrest brackets 95 and 96 are also pivotally interconnected by means of link 99, one end of which is pivoted to bracket 96 by pivot pin 100 and the other end of which is pivoted to bracket 95 by pivot pin 98. It will be seen that links 93, 99 together with brackets 95, 96 form a four-bar linkage.

Completing the footrest linkage mechanism is a generally L-shaped link 90 pivotally connected relative to bracket 95 by pivot pin 98. The other end of link 90 is pivotally connected by pin 91 to link 85. The intermediate portion of link 90 is pivotally connected by pivot pin 92 to one of the legs of link 87.

Referring now to FIG. 2, the footrest is extended and retracted in response to movement of the seat and backrest unit 16, 18 relative to the stationary frame 10 by means of a drive transmission link 110 which is elongated and straight and has its forward end pivotally connected by pivot pin 114 to an intermediate portion of footrest mounting link 70 adjacent but below its pivot 74 to seat link 50. The rear end of drive transmission link 110 is pivotally connected by pivot pin 112 to an upper projecting portion 52*a* of the rear seat mounting link 52. It will be seen that when the seat and backrest unit 16, 18 move forwardly relative to the stationary frame 10 by virtue of the occupant pulling-off the stationary armrests 13, the rear seat mounting link 52 will turn clockwise as viewed in FIG. 1 to drive transmission link 110 forwardly which, in turn, will cause the footrest mounting link 70 to move counterclockwise from its folded position (FIG. 2) to an open position (FIG. 4) which will cause the pantograph linkage 70, 72, 80 and 82, to extend from their retracted position shown in FIG. 2 to their extended position shown in FIG. 4. During the latter motion, link 85 will be extended moving in the counterclockwise direction which, in turn, will transmit a force to and drive link 87 forwardly which, in turn, will transmit an actuating force to link 90 which, in turn, will actuate the four-bar linkage constituted by brackets 95 and 96 and links 99 and 93 to unfold the footrest brackets 95 and 96 into the position shown in FIG. 4.

Stop Mechanisms

The extended position of the footrest linkage will be determind by a stop 120 fixed to an intermediate portion of link 80 to be engageable with the lower edge of footrest mounting link 72 as shown in FIG. 4. Stop 120 also determines the closed position of the linkage mechanism by engaging the underside of footrest mounting link 70 as shown in FIG. 2. To help determine the retracted position of the footrest brackets 95 and 96 and to avoid slack in the outer section of the footrest linkage mechanism, a stop 122 is provided on bracket 95 to be engageable with the edge of link 93 as shown in FIG. 2 when the parts are in the closed position.

It will thus be seen that the present invention will not only allow the front edge of the seat frame to be made with a soft construction; but also, the footrest supports are still capable of full extension without striking the floor and without requiring the height of the chair to be increased so as to keep within present day styling requirements.

The following claims contain drawing numerals to help the reader to ascertain the invention being claimed. However, unless clearly indicated in the claims, the numerals should not be construed as limiting the claimed invention to the specific embodiment shown in the drawings.

What is claimed is:

1. A one-way recliner chair including a stationary frame including stationary armrests, a seat and back unit movable as a one-piece structure relative to the stationary frame between a closed generally upright position and a reclining position, said seat and back unit including a seat frame having a soft construction along the front edge portion thereof, a footrest system including dual footrest supports mounted to said seat and back unit for movement between a closed position wherein the footrest supports are positioned one generally behind the other in generally vertical planes with one of the footrest supports being positioned below the front edge portion of the seat frame, and an extended position projected forwardly from the chair wherein the footrest supports are located in sloping but generally horizontal planes one behind the other, a linkage system mounting the seat and back unit for movement between said positions thereof relative to the stationary frame and for mounting the footrest supports relative to the seat and backrest unit for movement between said positions thereof; said linkage system including front and rear mounting links pivotally interconnected between the seat and frame unit and said stationary frame for moving the seat and back unit into a reclined position relative to the stationary frame when the chair occupant pulls-off the armrests, said linkage system including a footrest linkage including lazy tong linkage pivotally mounted to the seat and back unit, a transmission link interconnecting the lazy tong linkage and one of said front and rear mounting links (54, 52) for extending the footrest supports when the seat and back unit is moved into reclining position, said footrest linkage further including a pair of brackets respectively fixed to the footrest supports, a first link (99) pivotally interconnecting said footrest brackets, a second link (93) having two legs respectively pivotally connected to said footrest brackets, a third link (87) pivotally connected to the second link and pivotally connected to the lazy tong linkage, a fourth link (90) having one end pivotally connected to one of said footrest brackets and being pivotally connected at an intermediate portion thereof to said third link, said fourth link having an end pivotally connected to said lazy tong linkage such that upon movement of the seat and backrest unit into reclining position, the footrest supports will be moved from their retracted position below the seat and back unit to their extended position.

2. The recliner chair as defined in claim 1 wherein said lazy tong linkage includes a first generally parallel pair of footrest mounting links (70, 72) pivotally mounted to the back and seat unit, a second pair of generally parallel links (80, 82) pivotally connected to said first pair of generally parallel links, and a link (85) pivotally connected to both of said second pairs of generally parallel links and also pivotally connected to said third link (87), and wherein one (82) of said second pair of generally parallel links is pivotally connected to said fourth link (90).

3. The chair defined in claim 1 wherein said transmission link (110) is pivotally connected to said rear mounting link (52).

4. The chair defined in claim 2 wherein said transmission link (110) is pivotally connected to said rear mounting link (52).

5. The chair defined in claim 1 wherein said third and fourth links (87, 90) each have a generally inverted L-shape.

6. The chair defind in claim 4 wherein said third and fourth links (87, 90) each have a generally inverted L-shape.

7. The chair defined in claim 2 wherein there is further included a stop (120) fixed to one of said second pair of links engageable with one of said first pair of links to define the extended position of the footrest supports and engageable with the other of said first pair of links to define the retracted position of said footrest supports.

8. The chair defined in claim 6 wherein there is further included a stop (120) fixed to one of said second pair of links engageable with one of said first pair of links to define the extended position of the footrest supports and engageable with the other of said first pair of links to define the retracted position of said footrest supports.

* * * * *